United States Patent [19]

Gutter

[11] Patent Number: 4,927,388

[45] Date of Patent: May 22, 1990

[54] ELECTRICAL CONNECTOR SHELL ASSEMBLY AND MODULE RETENTION CLIP

[75] Inventor: David H. Gutter, Harrisburg, Pa.

[73] Assignee: AMP Incorporated, Harrisburg, Pa.

[21] Appl. No.: 414,814

[22] Filed: Sep. 29, 1989

[51] Int. Cl.[5] ..... H01R 13/62

[52] U.S. Cl. ..... 439/660; 439/686

[58] Field of Search ..... 439/660, 686, 701, 708, 439/744–749

[56] References Cited

U.S. PATENT DOCUMENTS

| | | | |
|---|---|---|---|
| 3,993,394 | 11/1976 | Cooper | 339/136 M |
| 4,653,837 | 3/1987 | Phillipson et al. | 439/701 |
| 4,709,976 | 12/1987 | Nakama et al. | 439/701 |
| 4,764,130 | 8/1988 | DiClemente | 439/686 |

OTHER PUBLICATIONS

Two Drawings of Connector Housings sold by Brintec Corporation–LISPC2–001 & LISPA2–002.

*Primary Examiner*—Joseph H. McGlynn
*Attorney, Agent, or Firm*—Anton P. Ness

[57] ABSTRACT

A protective shell of an electrical connector includes clip members affixed to the inside surfaces of the module-receiving cavity, with spring arms of the clips extending forwardly and inwardly to latch behind transverse ribs along the outwardly facing surfaces of the terminal modules inserted into the shell from its rearward face. Each clip includes a pair of outwardly directed tabs along lateral edges of the body section, and the tabs are inserted outwardly through associated longitudinal slits in the shell wall and then bent over along the outward surface of the shell, preferably into recesses to be flush with the outward shell surface. A pair of such clips along the upper inside surface and along the lower inside surface cooperate to retain a pair of terminal modules inserted into the shell in a manner permitting easy module removal from the shell.

3 Claims, 3 Drawing Sheets

ELECTRICAL CONNECTOR SHELL ASSEMBLY AND MODULE RETENTION CLIP

FIELD OF THE INVENTION

The present invention relates to the field of electrical connectors and more particularly to a connector having one or more multiterminal modules removably retained within a protective shell.

BACKGROUND OF THE INVENTION

Electrical connectors are known which have a plurality of terminals disposed in a dielectric housing and which are terminated to a respective plurality of conductor wires, and the housing then secured within a protective shell. In one such connector the terminals are disposed in a single row within a wafer-like dielectric housing or module and extend rearwardly from the housing, to conclude in termination sections comprising shallow channels termed solder tails. The module includes cylindrical portions extending rearwardly to surround the terminals forwardly of the solder tails. When the conductor wires are prepared to be terminated to the solder tails, individual sleeve-like solder preforms encased within respective longer sleeves of heat recoverable or heat shrink tubing are placed over the rearwardly extending terminal portions so that the solder preforms surround the solder tails; the stripped wire ends are then inserted into the heat recoverable tubing sleeves and into the solder preforms surrounding the solder tails. The assembly is then subjected to the application of thermal energy to melt the solder which then flows around the stripped wire ends within the solder tails and upon cooling forms respective solder joints joining the conductor wires to the terminals; and simultaneously the heat recoverable tubing is heated above a threshold temperature at which the tubing shrinks in diameter until it lies adjacent and tightly against surfaces of the solder tails and the wire termination therewithin, against a portion of the insulated conductor wire extending rearwardly therefrom, and against a portion of the terminal extending forwardly therefrom to the rearward housing surface covering the exposed metal surfaces. Within forward and rearward ends of the tubing are located short sleeve-like preforms of fusible sealant material which will shrink and also tackify upon heating to bond and seal to the insulation of the wire, and to the cylindrical housing portions therewithin and to bond to the surrounding heat recoverable tubing; the termination is thus sealed.

The module thus joined to the conductor wires is then placed within a module-receiving cavity of a protective shell such as a metal shell and is held therein by one or more spring clips, and a pair of such modules may be simultaneously retained together in the same shell by respective spring clips mounted along opposing inside shell surfaces. The spring clips permit removal of the one or two modules if desired but otherwise secure the one or two modules within the shell and against axial movement therewithin during handling, mating and unmating of the connector with a mating connector. The terminals within the one or two modules include contact sections extending forwardly to be exposed along a mating face to be electrically connected with corresponding contact sections of terminals of a mating connector.

In U.S. Pat. No. 3,993,394 particular spring clips are disclosed which include housing-engaging legs extending in a cantilevered fashion forwardly and inwardly from upper and lower side walls of a module-receiving cavity, to free ends which latch behind ribs of a pair of modules inserted into the cavity. The clips extend across the width of the module-receiving cavity and include cavity-wide mounting sections which are inserted outwardly through transverse slots in the upper and lower shell walls and are disposed in recesses extending rearwardly along outwardly facing surfaces of the shell walls. At each lateral end of each clip are legs extending forwardly along inside surfaces of the shell wall into recesses to maintain the clip in position after insertion. Another module-receiving shell with a system of retention clips securable therewithin, is disclosed in U.S. Pat. No. 4,764,130.

It is desired to provide a means for assuredly and simply mounting a module-retaining clip within a module-receiving cavity of a protective shell of a connector.

SUMMARY OF THE INVENTION

A connector shell assembly has a module-receiving cavity into which at least one terminal module is insertable from rearwardly thereof to define an electrical connector. The shell includes at least one clip member mounted within the cavity, and each clip has a spring arm extending forwardly from a mounting section and inwardly into the cavity to latch behind a rib of the terminal module after insertion of the module into the shell to retain the module in the shell. In the present invention each clip mounting section includes a substantially flat planar body section having a pair of initially outwardly extending tabs along lateral edges thereof; the shell includes a pair of longitudinal slits associated with the pair of tabs of each clip. During clip mounting, each clip is inserted into the cavity and its tabs are extended outwardly through the associated shell slits and then bent over along the outwardly facing surface of the shell, securing the clip to the shell so that the body section is held along the inwardly facing surface of said shell and its spring arm extends forwardly from the body section and inwardly into the module-receiving cavity. The outwardly facing surface of the shell may include recesses adjacent the longitudinal slits into which the bent over tabs of the clip are received, so that the bent over tabs are recessed into the outwardly facing surface of the shell.

An embodiment of the present invention will now be discussed with reference to the accompanying drawings.

DETAILED DESCRIPTION OF THE PREFERRED EMBODIMENT

Figure 1:
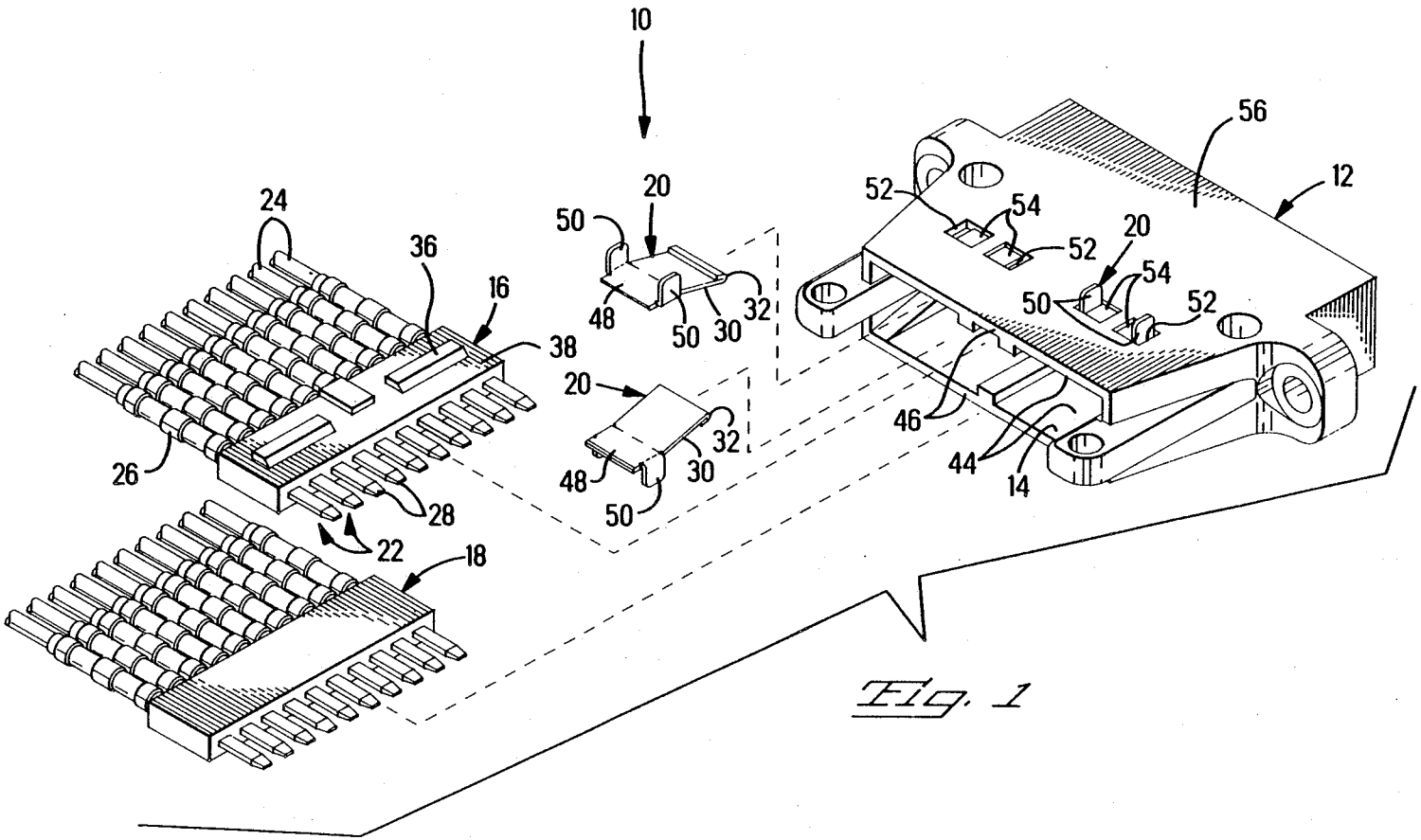
FIG. 1 is a perspective view of a connector showing a pair of terminal modules exploded from a protective shell, with a pair of retention clips of the invention exploded from the shell, while a third clip is shown being affixed to the inside of the shell.
Figure 2:
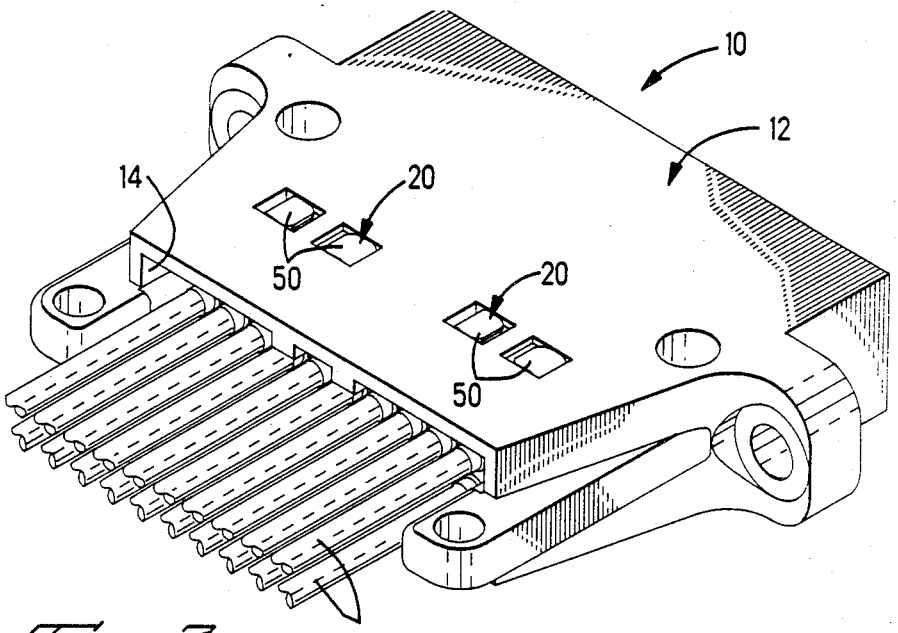
FIGS. 2 and 3 are perspective views of the assembled connector of FIG. 1, with FIG. 3 being an enlarged portion of FIG. 2 with part of the shell broken away showing the retention of the terminal module within the shell.
Figure 3:
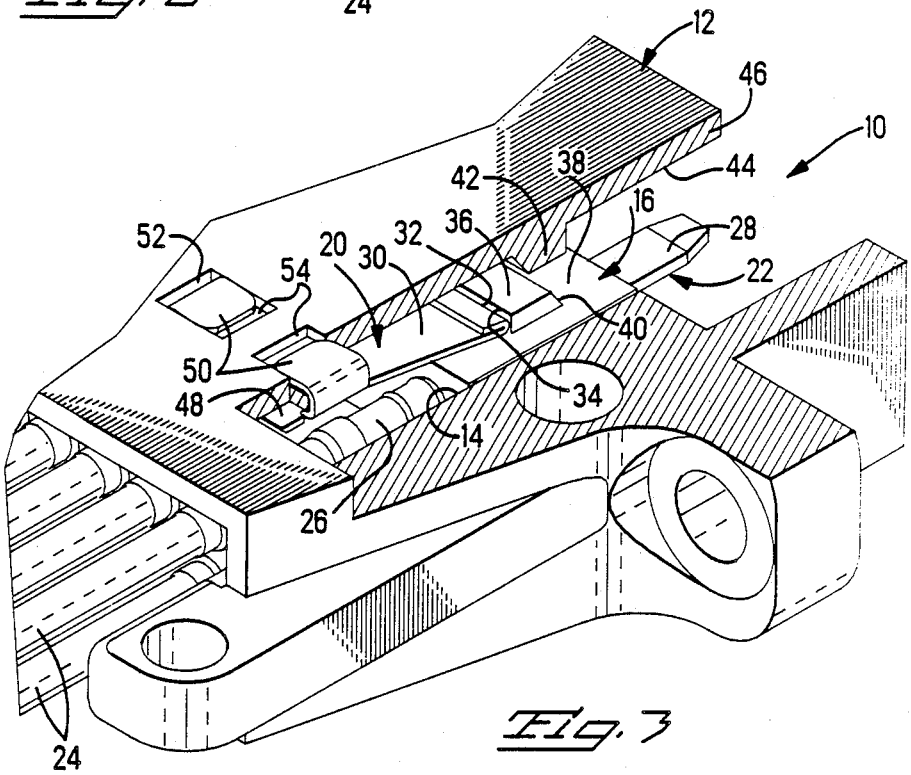

FIGS. 1 to 3 show a connector 10 having a protective shell 12 having a large module-receiving cavity 14 in which a pair of terminal modules 16,18 are secured by retention clips 20. Modules 16, 18 include a plurality of terminals 22 within dielectric material and disposed in single rows, each terminal being terminated to a respective conductor wire 24 and the termination being sealed within a length of dielectric tubing 26. Each terminal also includes a contact section 28 extending forwardly of its module and within the shell 12 to be mated to a corresponding contact section of a mating terminal of a mating connector (FIG. 4).

Figure 4:
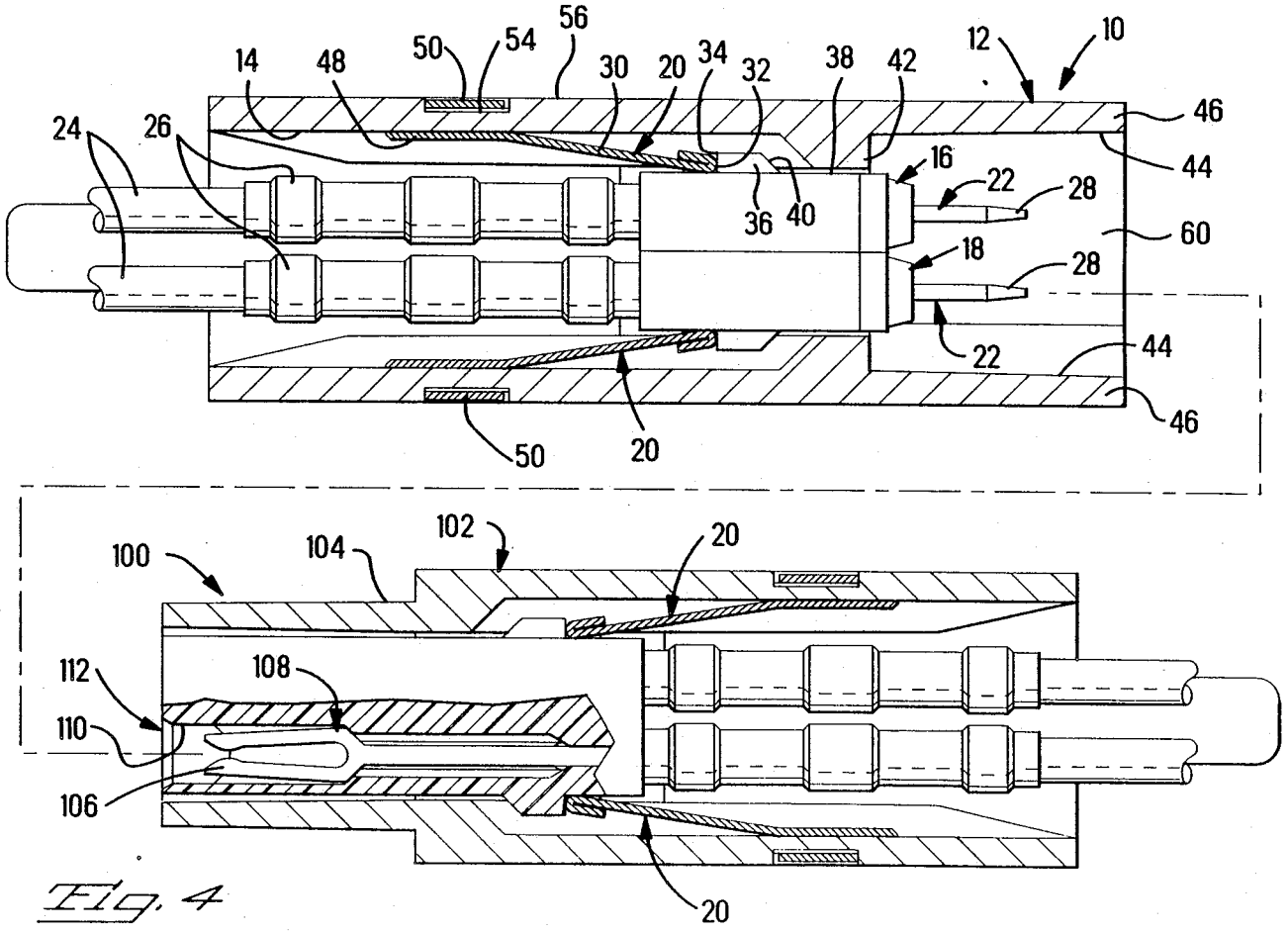
FIG. 4 is a longitudinal section view of an assembled connector about to be mated with a like mating connector in which the present invention is used.

Each retention clip 20 has a spring arm 30 extending forwardly and inwardly at a slight angle to a free end 32 which after assembly is disposed behind a rearwardly facing stop surface 34 of rib 36 molded along the outwardly surface 38 of an associated module, as seen in FIGS. 3 and 4. Rib 36 also includes a forwardly facing stop surface 40 which is engageable with a projection 42 extending inwardly into module-receiving cavity 14 from inside surfaces 44 of upper and lower walls 46 of shell 12, to prevent axial movement of the module forwardly beyond projection 42.

Referring to FIG. 1, each clip is affixed to an upper or lower inside surface 44 of shell 12 defining module-receiving cavity 14. Each retention clip 20 includes a body section 48 to which the spring arm 30 is integrally joined, and clip 20 is mounted to shell 12 so that body section 48 lies against inside shell surface 44 and spring arm 30 extends forwardly and inwardly into module-receiving cavity 14. Body section 48 includes a pair of tabs 50 along its lateral edges which initially extend perpendicularly outwardly; tabs are associated with respective longitudinal slits 52 through shell wall 46. During clip mounting, tabs 50 are inserted outwardly through slits 52 and are clinched or bent over firmly against the outer surface of shell wall 46, and are preferably disposed within recesses 54 to be flush with otherwise flat, planar outer surface 56 of shell 12.

Clip 20 is preferably stamped and formed of nonmagnetic stainless steel such as Series 300 alloy and passivated or cadmium plated. Shell 12 may be cast of aluminum alloy and plated with cadmium or nickel; slits 52 and recesses 54 could be formed during the casting process or be machined thereinto in a secondary operation. Optionally the shell could be molded of thermoplastic resin and subsequently plated on its outer surfaces with a conductive metal layer, providing shielding against electromagnetic and radiofrequency interference.

FIG. 4 illustrates connector 10 about to be mated with a mating connector 100. Shell 12 of connector 10 includes a receptacle section 60 in which contact sections 28 are disposed. Both modules 16,18 are held against each other to be kept within the shell, by spring bias applied by spring arms 30 of upper and lower clips 20; if one were to be removed, the other would not be retained within the shell assembly by itself.

Shell 102 of connector 100 includes a plug section 104 of reduced dimension adapted to be received into receptacle section 60. Socket contact sections 106 of terminals 108 are matable with blade contact sections 28, and are disposed within respective passageways 110 of a single two-row module retained within shell 102 by retention clips 20 of the present invention. During mating and unmating, modules 16,18 and 112 are limited in forward and rearward axial movement so that the contact sections are assuredly matable through the limited range of positions of the modules in the mated state, while the modules are able to be removed if desired by use of an appropriate tool (not shown) of thin planar shape inserted from rearwardly of the shell to deflect the clip spring arms against the inside surface of the shell allowing rear removal of the module.

The method of securing retention clips 20 in a shell 12 by clinched tabs 50 extending out through respective short slits 52 in shell 127, minimizes discontinuities in the conductive shell enclosure, which optimizes the benefits of shielding the modules against electromagnetic and radiofrequency interference (EMI/RFI). Such shielding is especially beneficial where signal and especially coaxial signal transmission is desired by using such connectors.

What is claimed is:

1. A retention clip for being affixed along an inside surface of a connector shell for retention of a terminal module therein, the clip being of the type having a mounting section and a module-engaging spring arm extending forwardly therefrom to a free end adapted to latch behind a transverse rib of the terminal module to prevent rearward axial movement of the module after insertion into the shell, the improvement comprising:

said mounting section comprising a body section having a pair of initially outwardly extending tabs along lateral edges of the body section, said tabs adapted to be inserted outwardly through associated longitudinal slits in the cavity-defining wall of the shell and then be bent over along the outwardly facing surface of the shell, securing the clip to the shell with the body section against the inwardly facing surface of the shell and the spring arm extending forwardly therefrom and inwardly into the shell cavity.

2. A connector shell assembly having a module-receiving cavity into which at least one terminal module is insertable from rearwardly thereof to define an electrical connector, the shell assembly being of the type having a shell and including at least one clip member mounted within the module-receiving cavity thereof and having a spring arm extending forwardly and inwardly into the cavity to latch behind a rib of the terminal module after insertion into the shell to retain the module in the shell, the shell assembly characterized in that:

each said clip member includes a body section having a pair of initially outwardly extending tabs along lateral edges thereof; and said shell includes a pair of longitudinal slits associated with said pair of tabs of each said clip member outwardly through which said tabs are inserted and bent over along the outwardly facing surface of said shell, securing said clip member to said shell with said body section along the inwardly facing surface of said shell, with said spring arm extending forwardly from said body section and inwardly into said module-receiving cavity.

3. A connector shell assembly as set forth in claim 2 wherein said outwardly facing surface of said shell includes recesses adjacent said longitudinal slits into which said bent over tabs of said clip member are received, whereby said bent over tabs are recessed into said outwardly facing surface of said shell.

* * * * *